US005459878A

United States Patent [19]

Gold

[11] Patent Number: 5,459,878

[45] Date of Patent: Oct. 24, 1995

[54] IN-LINE SKATE GLOVE SUSPENSION SYSTEM

[75] Inventor: Danny Gold, Hong Kong, Hong Kong

[73] Assignee: Kombi Ltd., Essex Junction, Vt.

[21] Appl. No.: 79,993

[22] Filed: Jun. 18, 1993

[51] Int. Cl.[6] ..... A41D 19/00; A41D 13/00

[52] U.S. Cl. ..... 2/161.1; 2/2; 2/227; 2/23

[58] Field of Search ..... 2/2, 23, 16, 17, 2/20, 22, 159, 160, 161.1, 161.6, 227, 228, 231

[56] References Cited

U.S. PATENT DOCUMENTS 5,140,995 8/1992 Uhl ..... 2/2

*Primary Examiner*—Clifford D. Crowder
*Assistant Examiner*—Gloria Hale
*Attorney, Agent, or Firm*—Aufrichtig Stein & Aufrichtig

[57] ABSTRACT

A protective guard suspension system for a joint covering for covering at least a portion of the wearer's hand and wrist includes an angled resilient guard member and two coupling members. The angled resilient guard member protects a portion of the wearer's hand and wrist and absorbs impact forces by reversibly deforming. The angled resilient guard member has first and second ends and an intermediate angled portion and also has first and second openings proximate to the each of the first and second ends. The first coupling couples the first end of the angled resilient guard member to the hand covering by extending through the first opening and forming a first loop at a first end of the first coupling and is coupled to the hand covering at a second end of the first coupling so that the first end of the angled resilient guard member is secured to the hand covering. The second coupling couples the second end of the angled resilient guard member to the hand covering and extends through the second opening, thus forming a second loop on a second end of the second coupling means which is in turn coupled to the hand covering at the second end of the second coupling means so that the second end of the angled resilient guard member is secured to the hand covering.

25 Claims, 3 Drawing Sheets

IN-LINE SKATE GLOVE SUSPENSION SYSTEM

BACKGROUND OF THE INVENTION

The invention is generally directed to a garment having a protection suspension system for providing an improved joint protective guard on a garment, and in particular, to an improved hand and/or wrist protective guard suspension system for use as an in-line skate glove or similar hand covering.

In various sports in which the participant moves quickly, such as roller skating, roller blading or in-line skating, without substantial body and arm and hand protection, the wearer's hands and wrists are particularly susceptible to injury in the event that the wearer falls or hits a wall or obstruction while traveling at a high rate of speed. This risk is particularly acute in connection with the new sport of in-line skating, in which a skater may easily reach speeds in excess of 20 miles per hour.

Generally, such a skater does not wear bulky protection such as is commonly worn by ice hockey or lacrosse players who might be liable to fall forward, largely on their hands or wrists while traveling at high rates of speed. When an ice hockey player falls, the player is usually wearing a highly padded pair of gloves which protect the player's hand and wrist from flying pucks, sticks and fists, as well as from injuries resulting from the natural instinct of a person to extend one's hands downward toward the ground to break or slow a fall.

However, in the relatively new sport of in-line skating, or the older roller skating, both of which are usually performed on streets or paved pathways, the participant can travel at particularly high rates of speed and is susceptible to traumatic injury to the hands and wrist in the event that a crack in the road, an awkward movement or collision occurs sending the skater's upper body downward and, again, resulting in the instinctual desire to break one's fall with one's hands.

Severe injuries can be caused to the hand and wrist by putting out one's hands out to break a fall in even a relatively slow speed fall. As a result, it has become common for in-line skaters to wear padding of various sorts on their knees, elbows and heads to prevent dangerous injury. In addition, gloves of various types have been developed to protect the wearer's hands in the event of a fall in connection with in-line skating and similar sports.

Some of the gloves have soft padding of various types. While these types of gloves are an aid to hand and wrist safety, they are not suitable for preventing injury in the event of a high speed fall where the hands are placed outward to break skater's fall.

In an effort to provide additional protection to the wearer's hands in the event of a traumatic fall, gloves have been developed which incorporate hard plastic protective guards sewn into sleeves or pockets on the palm side of the gloves. While these gloves have improved the degree of protection to the wearer's hands by forming a hard barrier between the wearer's hands and the ground upon impact, these protective guards, due to their construction, transmit the entire force of the traumatic contact with the ground to the wearer's hand and/or wrist in the region of the protective guard. As a result, these protective guards, while preventing direct contact of the wearer's hand with the road or pavement, do not effectively cushion the wearer's hand and wrist from the great forces concentrated on the wearer's hand when the weight of the skater's body is being supported at high speeds at the end of a fall.

Accordingly, there is a need for an improved hand covering or glove for use in in-line skating and similar sports and work activities in which the wearer's natural instinct to throw one's hands outward to break a fall seriously raise the possibility of substantial damage to the hand and wrist area or other joints of the body including without limitation, the knees, elbows, shoulders and hips.

SUMMARY OF THE INVENTION

The invention is generally directed to a protective guard suspension system for a joint covering garment, which covers at least a portion of a wearer's joint. An angled resilient guard member or members protect the portion of the wearer's joint and absorbs impact forces by reversibly deforming. The angled resilient guard member has first and second legs and an intermediate angled portion. The angled resilient guard member also has at least two openings, at least one in each of the first and second legs. The first coupling structure couples the first leg of the angled resilient guard member to the joint covering garment. The first coupling structure extends through the first opening. The second coupling structure couples the second leg of the angled resilient guard member to the joint covering garment. The second coupling structure extends through the second opening to couple the angled resilient guard member to the joint covering garment. As a result, the wearer's joint is protected by a suspension system formed of the joint covering garment, angled resilient guard member and first and second coupling structures, which causes the angled resilient guard member to slide, deflect and absorb energy upon impact of the intermediate angled portion of the angled resilient guard member and a surface resulting from a fall.

The invention is also generally directed to a protective guard suspension system for a hand covering which covers at least a portion of wearer's hand and wrist. An angled resilient guard member protects a portion of the wearer's hand and wrist and absorbs impact forces by reversibly deforming. The angled resilient guard member has first and second legs and an intermediate angled portion. The angled resilient guard member also has first and second openings in the first and second legs, respectively. A first coupling structure couples the first leg of the angled resilient guard member to the hand covering. The first coupling structure extends through he first opening and forms a first loop at a first end of the first coupling member and is also coupled to the hand covering at a second end of the first coupling structure so that the first leg of the angled resilient guard member is secured to the hand covering. A second coupling structure for coupling the second leg of the angled resilient guard member to the hand covering extends through the second opening and forms a second loop on the second end of the second coupling means. The second coupling structure is, on a second end of the second coupling structure, coupled to the hand covering proximate the second end of the second coupling member so that the second end of the angled resilient guard member is secured to the hand covering. As a result, at least a portion of the wearer's hand and wrist is protect by a suspension system which causes the angled resilient guard member to deflect and absorb energy upon impact of the intermediate angled portion of the angled resilient guard member and a surface resulting from a fall or accident.

Accordingly, it is an object of the invention to provide an improved protective guard suspension system for distributing and relieving the traumatic stress on a wearer's joints, including the hands and wrists during a fall.

Another object of the invention is to provide an improved suspension system which allows the energy of the fall to be partially absorbed by the protective guard of a joint protection and then released over time.

A further object of the invention is to provide an improved in-line skating glove which prevents injuries to the wearer's palm and wrist upon falls.

Yet another object of the invention is to provide an improved garment protective guard suspension system for protecting a wearer's joints upon traumatic impact in a fall or crash.

Still another object of the invention is to provide an improved suspension system for protecting a wearer's joints upon traumatic contact by absorbing a portion of the impact energy by use of a trampoline effect.

Yet a further object of the invention is to provide an improved method of protecting a wearer's body part through the use of a hard, flexible angled guard secured in a fashion to allow deflection of the plastic guard so that a portion of the impact force is absorbed by the guard.

Still other objects and advantages of the invention will, in part, be obvious and, in part, be apparent from the specification.

The invention, accordingly, comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF PREFERRED EMBODIMENT

Figure 1:
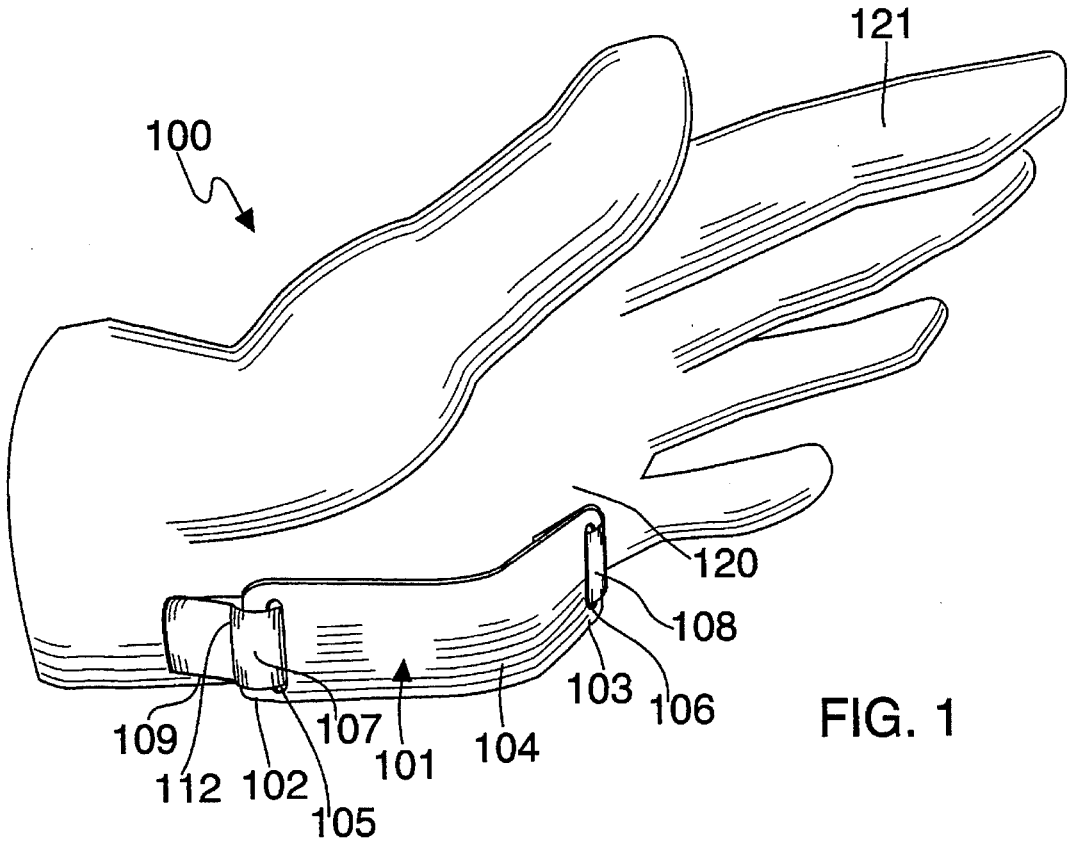
FIG. 1 is a perspective view of an in-line skate glove protective guard suspension system constructed in accordance with a preferred embodiment of the invention.
Figure 2:
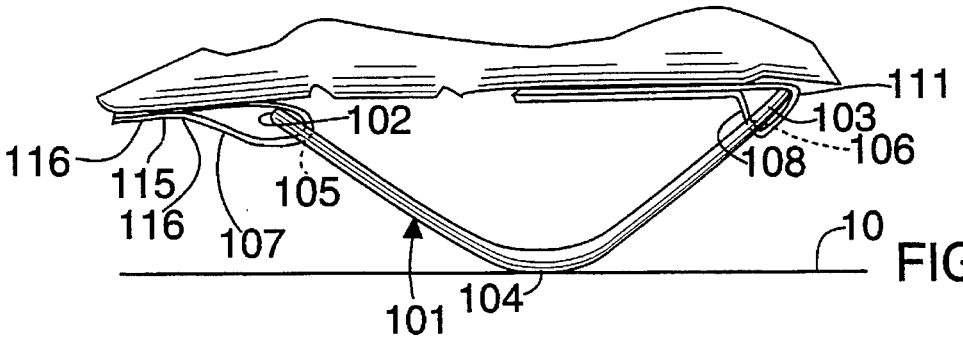
FIG. 2 is a partial front elevational view of an in-line skate glove protective guard suspension system in which contact between the protective guard and ground have just been made.

Reference is made to FIGS. 1 and 2, wherein a glove, generally indicated as 100, including a protective guard suspension system constructed in accordance with a preferred embodiment of the invention is indicated. Glove 100 is constructed in accordance with conventional technology and may be either a full fingered glove 121, including five full fingers or a fingerless glove. Glove 121 includes a palm portion 120. In addition, glove 121 may also be formed as a mitten or "lobster" hand covering, having two widened finger stalls for receiving two fingers each.

An angled protective member 101, which is adapted to protect a portion of the wearer's hand, is secured to glove 121 in palm region 120 so as to protect the heel of the wearer's hand. The protective guard 101 may also be attached so as to protect the wearer's wrist or other portion of the hand. Protective guard 101 is formed in an angled fashion best seen in FIG. 2. Guard member 101 includes legs 102 and 103 and generally rounded or angled central section 104. In a preferred embodiment, central section 104 is slightly thickened and rounded and is formed of an integral piece of a hard but resilient plastic material, such as delrin, polystyrene or polyvinyl chloride ("PVC"). Protective guard 101 also includes slots 105 and 106 proximate to the free ends of legs 102 and 103. Protective guard 101 is secured to palm portion 120 of glove 121 with straps 107 and 108 extending through slots 105 and 106 respectively. Strap 107 is looped through slot 105 near the free end of leg 102 of protective guard 101 and secured in place at double reinforced portion 115 by stitching 116. This results in a loop 112 being formed to contain end 102 of protective guard 101. The end of leg 102 of protective guard 101, in its unstressed and undeformed position as shown in FIGS. 1 and 2, is held loosely within loop 112 by strap 107. On the other hand, the free end of leg 103 of protective guard 101 is secured to palm portion 120 of glove 121 by a strap 108 looped through slot 106 near the free end of leg 103 of protective guard 101. Strap 108 is doubled up in reinforced portion 113 and is secured to palm portion 120 by stitching 114. As compared to the free end of leg 102 of protective guard 101, the free end of leg 103 is securely fixed within a loop 111 formed by strap 108.

As a result of the method of attachment of protective guard 101 to the palm portion 120 of glove 121, the protective guard is held generally in place with leg 103 maintained in a relatively tight fashion in place with leg 102 having more flexibility of movement.

Figure 3:
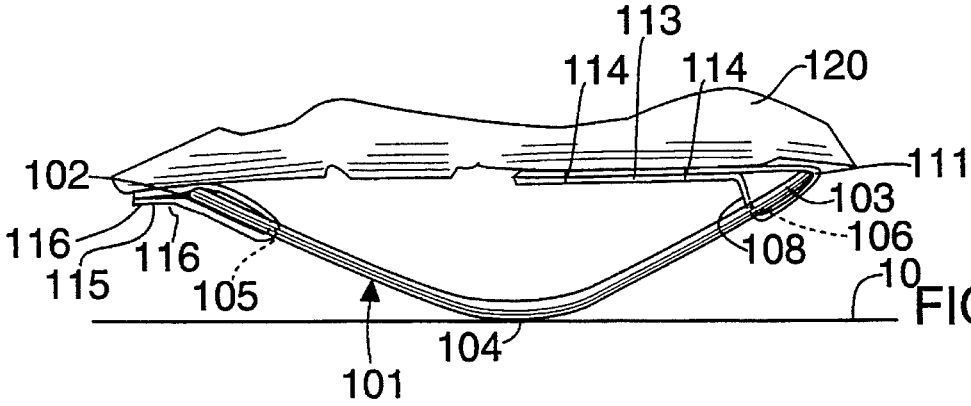
FIG. 3 is a partial front elevational view similar to the view of FIG. 2 in which the protective guard has been deformed in response to a violent contact between the protective guard and the ground.

This attachment structure evidences its utility when curved central portion 104 makes violent contact ground or road 10. In FIG. 2, the protective guard portion 104 is shown just as it contacts road 10 prior to any forces acting between protective guard 101 and road 10. FIG. 3 shows protective guard 101 in its fully deformed condition in which resilient guard 101 absorbs some of the energy of the impact with road 10 and is deformed so that it flattens, with legs 102 and 103 spreading apart. Leg 102 moves laterally until it strains the bounds of loop 112. As shown in FIG. 3, loop 111 remains essentially unchanged, with only a slight deformation and stretching of nylon or leather strap 108. However, the force exerted against curved central portion 104 of protective guard 101 causes protective guard member 101 to flatten and cause the distance between the free end of leg 103 and the free end of leg 102 to enlarge. This distance lengthens to the extent established by the size of loop 112 and the relative flexibility of straps 107 and 108.

To the extent that protective guard member 101 is flattening or deforming upon contact with the ground or floor 10, the energy of the impact of the hand against ground 10 is absorbed by guard member 101 rather than transmitted directly to the wearer's hand or wrist. Finally, when guard member 101 reaches the maximum extent of its deformation, controlled by the size of loops 112 and 111, and the relative flexibility of straps 107 and 108, the remaining energy is then transferred to the wearer's hand. By adjusting the angle of protective guard 101, and selecting the spring coefficient of the protective guard material, the size of loops 111 and 112 and the stretchability of straps 107 and 108, a manufacturer can build an appropriate amount of energy absorption into the protective guard suspension system of glove 100 depending upon the intended application.

After the traumatic contact with ground 10, and with the guard 101 in the fully stressed position shown in FIG. 3, the energy absorbed by protective guard 101, which acts as a spring, is stored as potential energy. Protective guard member 101, upon disengagement with ground 10, returns to its undeformed, at rest, position shown in FIGS. 1 and 2. The energy absorbed by guard member 101 during the collision with the ground is then released as the guard member 101, acting as a spring, returns to its unbiased or undeformed condition. In this fashion, the great force between the wearer's hand and the ground during a fall is reduced in severity by directing some of the energy into the increased potential energy stored in the "spring" 101, and by expanding the time over which the force acts on the wearer's hand. Rather than exerting a damaging large force on the wearer's hand for a very brief period of time, a substantially reduced force, applied over a longer time, is provided. In addition, the force is moved laterally away from the joint by the suspension system shown as indicated.

The protective guard member 101, as shown and described, acts in many ways like a trampoline. Like a trampoline jumper, a fall results in a very substantial force being exerted upon the surface of the trampoline. Rather than immediately attempting to stop the force, the trampoline deforms and absorbs much of the relative kinetic energy between the jumper and the trampoline surface. Only after the downward force of the jumper is less than the potential energy built up in the trampoline material, does the jumper stop moving downward and begin moving upward. This has the effect of cushioning the jumper's impact and also has the effect of spreading the absorption of the jumper's force by the trampoline over a greater period of time. Likewise, protective guard 101, upon the impact between curved portion 104 and ground 10 causes protective guard member 101 to begin flattening out and absorbing the energy of the impact until the force of the impact has been absorbed to a point that the remaining downward force of the impact is balanced by the uncoiling force of the uncoiling spring in 101. In this way, the kinetic energy of the great energy necessary to stop a wearer's hand in its downward impact with the ground in a fall, is converted into the potential energy in the spring, which guard member 101 is, before that energy is then again released as the unleashing or uncoiling motion of spring 101.

By making leg 103 of protective guard member 101 relatively fixed, the downward force is also translated into a horizontal force to a certain extent as the deformation is largely a movement in the direction of end 105. In this way, the downward force against the hand or wrist to be protected is not only reduced in size and extended over a greater period of time, but is directed in a non-damaging direction and in a less sensitive location.

In a preferred embodiment, straps 107 and 108 are formed from a leather or nylon material which is strong, flexible, durable and may be adjusted in thickness and stiffness so as to tune the relative degree of motion of guard member 101. Likewise, the size of loops 111 and 112 can be adjusted based upon the flexibility of guard member 104 and the expected forces of falling. For example, in a glove for a small child, the forces involved are substantially less and lighter gauge or weight materials may be utilized with similar impact. If the materials are too stiff, so that there is no deformation at all, then the shock absorbing benefits of the suspension system are lost.

In a preferred embodiment, the shock absorbing, protective guard member 101 is formed of a delrin, a cast rubbery plastic material which is not easily deformed without substantial force being exerted on the guard 101.

Figure 4:
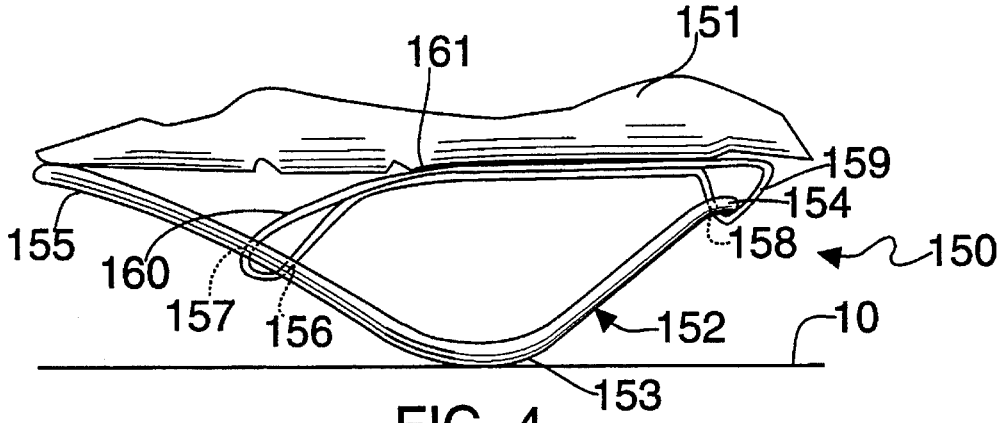
FIG. 4 is a partial front elevational view, similar to FIG. 2, of an in-line skate glove protective guard suspension system in accordance with another embodiment of the invention in which contact between the protective guard and the ground have just been made.
Figure 5:
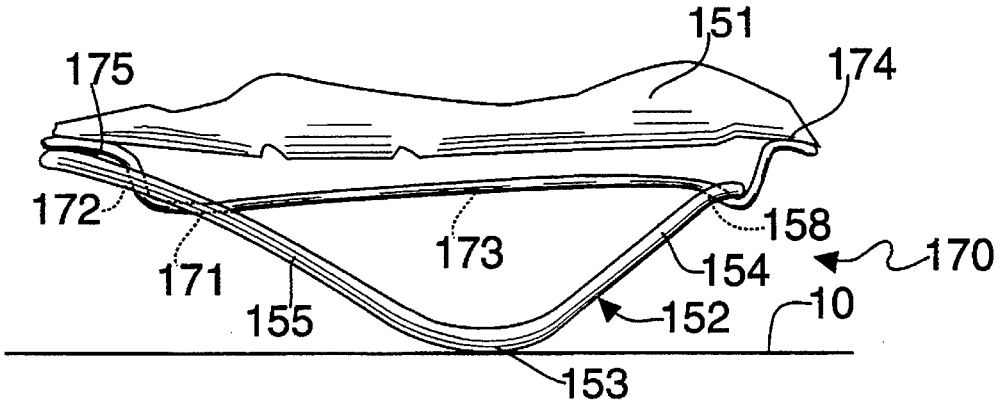
FIG. 5 is a partial front elevational view, similar to FIG. 2, of an in-line skate glove protective guard suspension system in accordance with a further embodiment of the invention in which contact between the protective guard and the ground have just been made.
Figure 6:
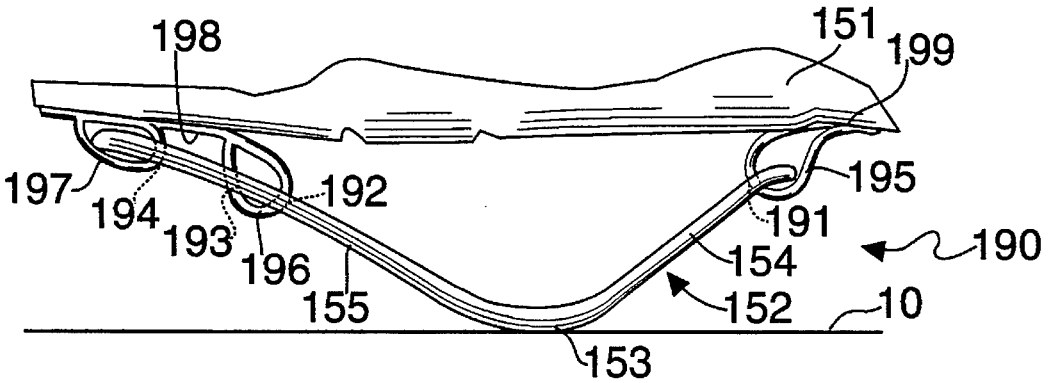
FIG. 6 is a partial front elevational view, similar to FIG. 2, of an in-line skate glove protective guard suspension system in accordance with yet another embodiment of the invention in which contact between the protective guard and ground have just been made.
Figure 7:
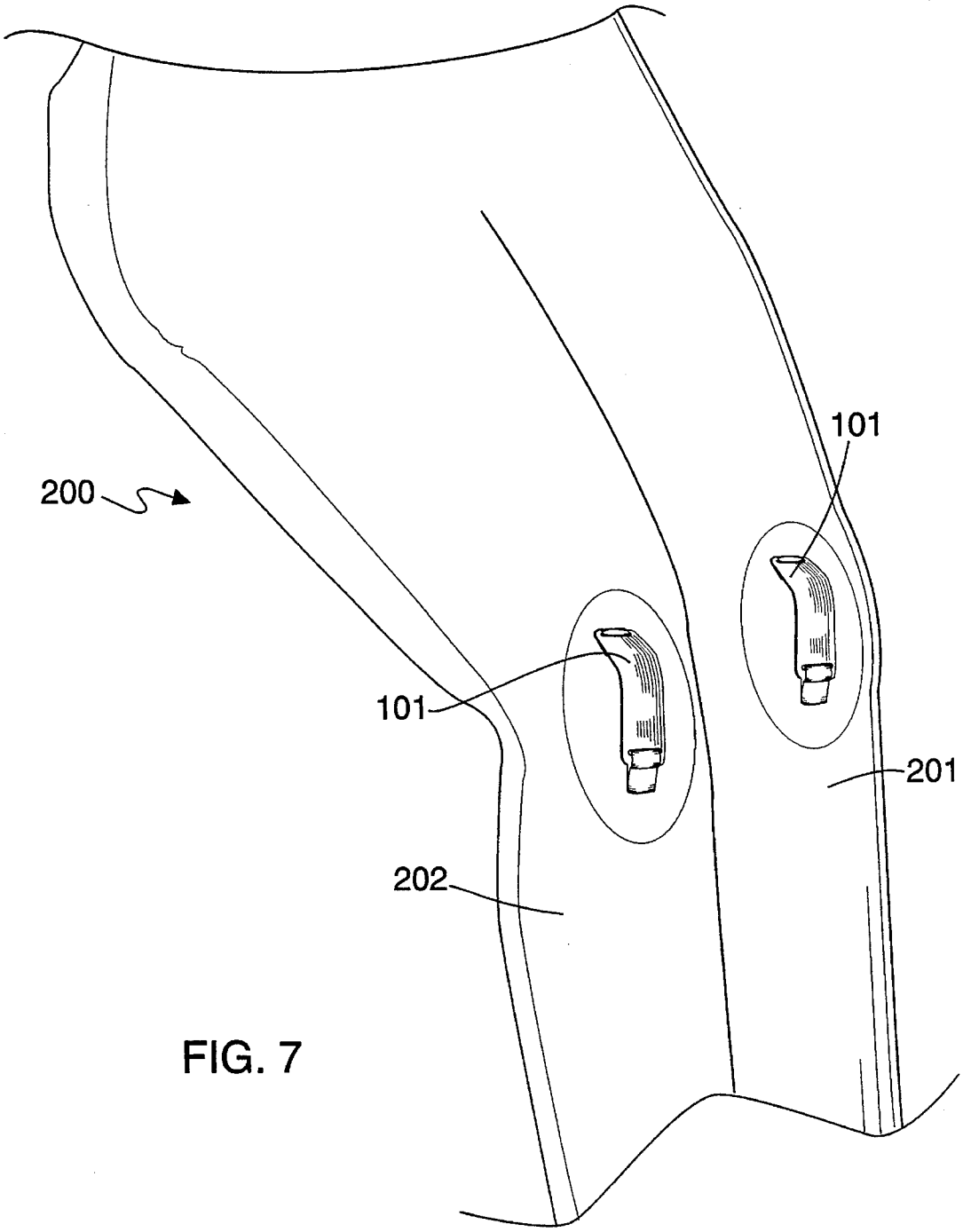
FIG. 7 is a perspective view of a pair of pants constructed in accordance with another preferred embodiment of the invention.

Reference is next made to FIGS. 4, 5 and 6, in which alternate suspension systems utilized in connection with preferred embodiments of the invention are depicted, like reference numerals referring to like elements.

Reference is made to FIG. 4, wherein a joint protection suspension system generally indicated as 150 constructed in accordance with another preferred embodiment of the invention is depicted. Joint protection system 150 includes a glove 151 and a protective guard member 152. Protective guard member 152 includes an angled, intermediate portion 153, shorter leg 154 and longer leg 155. Shorter leg 154 includes an opening 158, proximate the free end of leg 154. Longer leg 155 includes openings 156 and 157 proximate the middle of longer leg 155. Protective guard member 152 is secured to glove 151 by strap loops 159 and 160 which are secured to glove 151 in region 161. Loop 159 extends through opening 158 proximate the free end of shorter leg 154. Loop 160 extends through openings 156 and 157 proximate the middle of longer leg 155. Longer leg 155 is sized so as to extend beyond the wearer's wrist region to cover a portion of the lower arm. In this way, when the wearer falls, as shown in FIG. 4 and angled portion 153 contacts ground 10, the impact is both downward and toward the right from the orientation depicted in FIG. 4, which has the effect of causing glove 151 to move laterally to the right relative to protective guard member 152 prior to deformation commencing. In this way, the force of the impact is not only distributed over time, it is also shifted away from the joint, which is protected by the protective guard member.

Reference is next made to FIG. 5, wherein a joint protection glove constructed in accordance with another embodiment of the invention, generally indicated as 170, is depicted. Like elements are represented by like reference numerals. Joint protection glove 170 includes a glove portion 151, protective member 152, having angled portion 153 and shorter leg 154 and longer leg 155, as well as an opening 158 proximate the end of shorter leg 154. Longer leg 155 includes openings 171 and 172 near the free end of longer leg 155. The openings are generally formed as slots having a width and thickness slightly larger than the width and thickness of the straps looped through them. The width of the strap does not, of course, extend across the entire width of the protective guard member. Protective guard member 152 is suspended upon and attached to glove 151 by a strap 173 which is secured, such as by stitching, at one end in region 174 to glove 151. Strap 173 then wraps around the free end of shorter leg 154, through opening 158, to the inside of protective guard member 152, then out through opening 171 to the exterior of guard member 152, looping through opening 172 to the interior of guard member 152 and then being secured at its other end 175 to glove 151. Generally, strap 173 is relatively taut in its attached form. However, upon impact, which would have a force generally downward and to the right as seen from the orientation depicted in FIG. 5, glove 151 and the wearer's hand and wrist would continue to the right prior to deformation of protective guard member 152 so that the force of the impact would be both displaced laterally and absorbed and distributed by the suspension system depicted.

Reference is next made to FIG. 6, wherein a joint protection glove generally indicated as 190 constructed in accordance with another preferred embodiment of the invention is depicted. Like reference numerals correspond to like elements. Joint protection glove 190 includes a glove portion 151 and a protective guard member 152 having an intermediate angled portion 153, shorter leg 154 and longer leg 155. Shorter leg 155 has an opening 191, and longer leg 155 has openings 192 and 193 between angled portion 153 and the free end of leg 155 and an additional opening 194 proximate the free end of leg 155. Thus, this embodiment has four openings, as compared to the three openings of the embodiments of FIGS. 4 and 5 and the two openings of the embodiment of FIGS. 1 and 2. Strap 195 extends over the outside of the free end of shorter leg 154 through opening 191 to the inside of protective member 152 and is then secured to form a loop at doubled strap region 199. Generally, the straps are stitched to each other and to the glove. At the other end, a loop 196 is formed by the strap extending outward through opening 192 and inward through opening 193. The double loops are then secured to each other and glove 151 by stitching in region 198. A loop 197 is formed around the free end of longer leg 155 and through opening 194. This embodiment is a combination of the embodiments of FIGS. 2 and 4, incorporating loops at the ends of legs 154 and 155, as well as a loop at an intermediate portion of longer leg 155.

Various other arrangements of the straps and openings are feasible for providing the suspension system which allows both a lateral transformation of energy and absorption of the impact force. While the glove is shown in FIG. 1 as being a normal fingered glove, in practice, the gloves are often formed without any finger portion, the glove merely extending to cover the knuckles. In addition, a strap may be added around the glove in the region of the longer leg 155. This provides additional stability to protect the protective guard member 152 but does not restrict its motion both laterally and in deformation. The gloves themselves are well known in the art.

The same suspension principal may be utilized in connection with other types of joint protective garments. Reference is generally made to FIG. 4, wherein a pair of pants generally indicated as 200, constructed in accorded with another preferred embodiment of the invention is depicted, like reference numerals representing like elements. Pants 200 include on pant legs 201 and 202 protective guard members 101, attached in the same fashion as shown in FIGS. 1 and 2. Protective guard members 101 are attached over the portion of pants 200 extending over the knees. Guard members 101 are sized so as to suitably protect the wearer's knee.

The protective guard members 101 attached with a suspension system as shown and described may also be utilized in connection with other protective garments, such as garments covering the wearer's elbows, shoulders or any other portion of wearer's body coming in rapid contact with the ground in a crash or a traumatic contact.

Generally, the flexibility of the suspension system may adjust so that the maximum expected stress falls with the range of deformation of the protective guard member 101. Once guard member 101 reaches its fully deformed state as shown in FIG. 3, any additional force still not absorbed by the energy absorption by spring 101 will be directly communicated to the wearer. Therefore, the determination of the maximum expected impact force is indicated so that an appropriate size, thickness and flexibility of protective guard member 101 and sizes of loops 111 and 112 may be implemented to provide effective protection.

Accordingly, an improved protective glove and garment which acts to absorb high impact forces and protect the wearer's body part, particularly in connection with a fall or other traumatic impact by utilizing a spring suspension system incorporated into the protective guard member and its suspended attachment is provided.

It will thus be seen that the object set forth above, among those made apparent from the preceding description, are efficiency attained, and, since certain changes may be made in the above constructions without departing from the spirit and scope of the invention, it is intended that all matter contained in the above description or as shown in the accompanying drawings shall be interpreting as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A protective guard suspension garment system for a joint covering comprising:

a joint covering garment for covering at least a wearer's joint;

angled resilient guard means for protecting the wearer's joint and for absorbing impact forces by deforming, said angled resilient guard means having first and second legs and an intermediate angled portion, said angled resilient guard means having at least one opening in said first leg and at least one opening in said second leg;

first coupling means for coupling the first leg of the angled resilient guard means to the joint covering garment, said first coupling means extending through the at least one opening in the first leg of the angled resilient guard means, at least one end of said first coupling means being coupled to the joint covering garment; and second coupling means for coupling the second leg of the angled resilient guard means to the joint covering garment, said second coupling means extending through the at least one opening in the second leg and being coupled on at least one end to the joint covering garment;

wherein the first and second coupling means are formed out of flexible straps;

whereby the wearer's joint is protected by a suspension system which causes the angled resilient guard means to deflect and absorb energy upon impact of the intermediate angled portion of the angled resilient guard means and a surface resulting from a collision.

2. The protective guard suspension system of claim 1, wherein the joint covering garment is a glove covering the wearer's wrist joint and, at least, a portion of the wearer's hand.

3. The protective guard suspension system of claim 1, wherein the flexible straps are secured to the garment by stitching.

4. The protective guard suspension system of claim 1, wherein the first coupling means is formed as a strap which includes a first end and a second end and a loop is formed by the first coupling means through the first opening in the first leg of the angled resilient guard means and the first and second ends are secured to the garment.

5. The protective guard suspension system of claim 1, wherein the second coupling means is formed as a strap which includes a first end and a second end and a loop is formed by the second coupling means through the opening in the second leg of the angled resilient guard means and the first and second ends are secured to the garment.

6. A protective guard suspension garment system for a joint covering comprising:

a joint covering garment for covering at least a wearer's joint;

angled resilient guard means for protecting the wearer's joint and for absorbing impact forces by deforming, said angled resilient guard means having first and second legs and an intermediate angled portion, said angled resilient guard means having at least one opening in said first leg and at least one opening in said second leg;

first coupling means for coupling the first leg of the angled resilient guard means to the joint covering garment, said first coupling means extending through the at least one opening in the first leg of the angled resilient guard means, at least one end of said first coupling means being coupled to the joint covering garment; and second coupling means for coupling the second leg of the angled resilient guard means to the joint covering garment, said second coupling means extending through the at least one opening in the second leg and being coupled on at least one end to the joint covering garment;

wherein the first coupling means and the second coupling means are a single strap secured at one end to the garment means proximate the first opening in the first leg of the angled resilient guard means, said second leg of the angled resilient guard means having two openings, said strap extending through both openings in said second leg of the angled resilient guard means and said second end of said strap being secured to the garment proximate to the second opening in the second leg of the angled resilient guard means; whereby the angled resilient guard means is suspended proximate the protected joint, whereby the wearer's joint is protected by a suspension system which causes the angled resilient guard means to deflect and absorb energy upon impact of the intermediate angled portion of the angled resilient guard means and a surface resulting from a collision.

7. A protective guard suspension system for a hand covering, comprising:

a hand covering for covering at least a portion of a wearer's hand and wrist;

angled resilient guard means for protecting a portion of the wearer's hand and wrist and for absorbing impact forces by deforming, said angled resilient guard means having first and second ends and an intermediate angled portion, said angled resilient guard means having first and second openings proximate each of said first and second ends;

first coupling means for coupling the first end of the angled resilient guard means to the hand covering, said first coupling means extending through the first opening and forming a first loop on a first end of the first coupling means and being coupled to the hand covering at a second end of the first coupling means; and second coupling means for coupling the second end of the angled resilient guard means to the hand covering, said second coupling means extending through the second opening and forming a second loop on a second end of the second coupling means and being coupled to the hand covering at a second end of the second coupling means;

whereby the at least a portion of the wearer's hand and wrist is protected by a suspension system which causes the guard means to deflect and absorb energy upon an impact of the intermediate angle portion guard means and a surface resulting from a fall or accident.

8. The protective guard suspension system for a hand covering of claim 7 wherein the angled resilient guard means is formed of a single piece of cast plastic.

9. The protective guard suspension system for a hand covering of claim 7 wherein the first and second coupling means are formed of nylon straps.

10. The protective guard suspension system for a hand covering of claim 7 wherein the first loop is larger than the second loop.

11. The protective guard suspension system for a hand covering of claim 10 wherein the second loop snugly encircles the second opening in the angled resilient guard means and the second end of the angled resilient guard means.

12. The protective guard suspension system for a hand covering of claim 7 wherein the first loop is formed of a single strip of material and the second end of the first covering means is a doubled over strip of the material which is secured to the hand covering.

13. The protective guard suspension system for a hand covering of claim 7 wherein the second loop is formed of a single strip of material and the second end of the second covering means is a doubled over strip of the material which is secured to the hand covering.

14. The protective guard suspension system for a hand covering of claim 11 wherein the first loop is formed of a single strip of material and the second end of the first covering means is a doubled over strip of the material which is secured to the hand covering.

15. The protective guard suspension system for a hand covering of claim 13 wherein reinforcing portions of the first and second coupling means are each stitched to the hand covering.

16. The protective guard suspension system for a hand covering of claim 14 wherein reinforcing portion of the first coupling means is coupled to the hand covering between the first and second ends of the angled resilient guard means.

17. The protective guard suspension system for a hand covering of claim 7 wherein reinforcing portion of the first coupling means is coupled to the hand covering outside of the space between the first and second ends of the angled resilient guard means.

18. The protective guard suspension system for a hand covering of claim 15 wherein reinforcing portion of the first coupling means is coupled to the hand covering outside of the space between the first and second ends of the angled resilient guard means.

19. The protective guard suspension system for a hand covering of claim 7 wherein the size of the first and second loops limit deformation of the angled resilient guard means.

20. The protective guard suspension system for a hand covering of claim 18 wherein a coefficient of deformation of the angled resilient guard means is selected so that a maximum deformation is not reached upon exertion of an anticipated maximum impact force.

21. The protective guard suspension system for a hand covering of claim 7 wherein the angled resilient guard means protects the heal of the wearer's hand.

22. The protective guard suspension system for a hand covering of claim 7 wherein the angled resilient guard means protects the wearer's wrist.

23. The protective guard suspension system for a hand covering of claim 7 wherein the first and second openings are generally rectangular openings, generally parallel to the first and second ends of the angled resilient guard means, respectively.

24. A protective guard suspension system for a garment, comprising: a garment for covering at least a portion of a wearer's body, including a joint or other anticipated impact contact point;

angled resilient guard means for protecting a portion of the wearer's protected body part and for absorbing impact forces by reversibly deforming, said angled resilient guard means having first and second ends and an intermediate angled portion, said angled resilient guard means also having first and second openings proximate each of said first and second ends;

first coupling means for coupling the first end of the angled resilient guard means to the body part covering, said first coupling means extending through the first opening and forming a first loop at a first end of the first coupling means and being coupled to the garment at the second end of the first coupling means, so that the first end of the angled resilient guard means is secured to the garment; and second coupling means for coupling the second end of the angled resilient guard means to the garment, said second coupling means extending through the second opening and forming a second loop on the second end of the second coupling means and being coupled to the hand covering at a second end of the second coupling means so that the second end of the angled resilient guard means is secured to the garment;

wherein the first loop is larger than the second loop so that upon deformation of the angled resilient guard means, upon impact, the angled resilient guard means deforms so as to stretch the first loop.

25. The protective guard suspension system for a garment of claim 24 wherein the garment is a pair of pants for covering at least a portion of the wearer's legs wherein the pair of pants has two angled resilient guard means for protecting the wearer's knees, each of said angled resilient guard means being secured proximate to wearer's knee by way of separate first and second coupling means.

* * * * *